US006947676B2

(12) United States Patent
Hayakawa

(10) Patent No.: US 6,947,676 B2
(45) Date of Patent: Sep. 20, 2005

(54) IMAGE FORMING APPARATUS AND CONTROLLING METHOD THEREFOR DETERMINING STATE USE OF CARTRIDGE

(75) Inventor: Akira Hayakawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/136,388

(22) Filed: May 2, 2002

(65) Prior Publication Data

US 2002/0164168 A1 Nov. 7, 2002

(30) Foreign Application Priority Data

May 7, 2001 (JP) ..... 2001-136493

(51) Int. Cl.[7] ..... G03G 15/00
(52) U.S. Cl. ..... 399/25; 399/53
(58) Field of Search ..... 399/25, 27, 29, 399/12, 13, 254, 255, 258, 53, 43, 222

(56) References Cited

U.S. PATENT DOCUMENTS 4,711,555 A * 12/1987 Toshimitsu et al. ..... 399/343
4,945,388 A * 7/1990 Tange et al. ..... 399/347
5,166,730 A * 11/1992 Urabe ..... 399/59
5,710,956 A * 1/1998 Kurohata et al. ..... 399/24
5,930,553 A * 7/1999 Hirst et al. ..... 399/8
6,128,456 A 10/2000 Chigono et al. ..... 399/176
6,226,463 B1 * 5/2001 Phillips et al. ..... 399/24
6,408,141 B1 * 6/2002 Tahara ..... 399/12
6,564,024 B2 * 5/2003 Asano et al. ..... 399/53
6,580,890 B2 * 6/2003 Phillips et al. ..... 399/222

FOREIGN PATENT DOCUMENTS

JP 07092752 A * 4/1995 ..... G03G/15/00
JP 09073254 A * 3/1997 ..... G03G/21/00
JP 10-307455 11/1998
JP 2001-56601 2/2001
JP 2001-117442 4/2001

* cited by examiner

*Primary Examiner*—Robert Beatty
(74) *Attorney, Agent, or Firm*—Fitzpatrick, Cella, Harper & Scinto

(57) ABSTRACT

An image forming apparatus is used together with a process cartridge which is detachably attachable to the image forming apparatus and which includes an electrophotographic, photosensitive body, a developing device provided with at least a developer containing portion for containing a developer and a developer carrying body for supplying the developer to the electrophotographic, photosensitive body as process devices acting on the electrophotographic, photosensitive body, and a memory device, and the image forming apparatus is constructed to execute a predetermined initial operation before formation of an image when it is determined that the process cartridge is in an early stage of use, based on information in the memory device. This structure provides an image forming apparatus and process cartridge capable of forming good images from the early stage of use of the process cartridge.

6 Claims, 6 Drawing Sheets

IMAGE FORMING APPARATUS AND CONTROLLING METHOD THEREFOR DETERMINING STATE USE OF CARTRIDGE

BACKGROUND OF THE INVENTION

1. Field of the Invention

The present invention relates to an image forming apparatus, a control method thereof, and a process cartridge which is detachably attachable to the image forming apparatus.

The image forming apparatus herein embraces, for example, electrophotographic copying machines, electrophotographic printers (e.g., LED printers, laser beam printers, etc.), electrophotographic facsimile machines, electrophotographic word processors, and so on.

The process cartridge refers to a cartridge which integrally incorporates charging means, developing means, or cleaning means as process means acting on an image bearing body such as an electrophotographic, photosensitive body or the like, and the image bearing body and which is detachably attachable to the main body of the image forming apparatus, or a cartridge which integrally incorporates at least one of the charging means, developing means, and cleaning means, and the image bearing body and which is detachably attachable to the main body of the image forming apparatus, or a cartridge which integrally incorporates at least the developing means and the image bearing body and which is detachably attachable to the main body of the image forming apparatus.

2. Description of Related Art

Among the conventional image forming apparatus using the electrophotographic image forming process, such as the copying machines, laser beam printers, etc., there are maintenance-free image forming apparatus realized in such structure that a cartridge integrally incorporates the image bearing body such as the electrophotographic, photosensitive body or the like, and the process means acting on the electrophotographic, photosensitive body, e.g., a cleaning unit and/or a developing unit, and that the process cartridge is detachably attachable to the main body of the image forming apparatus.

In such image forming apparatus, for example, when a function of a component incorporated in the process cartridge is degraded after long-term use, the entire process cartridge is replaced. This replacing work is extremely simple work; for example, opening the main body of the image forming apparatus through a one-touch operation, removing an old process cartridge from the interior of the main body of the apparatus, and then mounting a virgin process cartridge onto the main body of the apparatus. Accordingly, a user can readily perform the replacing work by himself or herself, without depending upon a service person.

In the many conventional electrophotographic processes of the image forming apparatus as described above, triboelectrification (frictional charging) is used as a method of giving charge to toner as a developer. In general, a developing device carrying out the method of this type is provided with a developer carrying member of a roller shape for carrying and conveying a developer to an electrostatic, latent image formed on the electrophotographic, photosensitive body, and a developer layer thickness regulating member of a blade shape for applying the developer onto the developer carrying member.

For example, in the early stage of use of the process cartridge, however, the toner in the developing device is not rubbed sufficiently against such members as the developer carrying body and the developer regulating member and thus fails to bear sufficient charge, and there can occur a problem that the density is insufficient. In the case where the developing device is not used over a long period of time, charging on the toner can be attenuated and this can cause failure in forming an image of satisfactory density.

Further, as disclosed in Japanese Patent Application Laid-Open No. 10-307455, one of methods of charging the electrophotographic, photosensitive body by the use of charging accelerating particles is a method of supplying the charging accelerating particles from the interior of the developing device to a charging portion. In this charging method, however, since the charging accelerating particles are absent in the charging portion in the initial stage of the process cartridge, charging is insufficient, which can cause disturbance of images or the like due to charging failure. In order to avoid this problem, it is possible to provide the charging portion with some amount of charging accelerating particles in the production process. However, vibration or the like during transportation of the process cartridge can possibly peel off or deflect the charging accelerating particles preliminarily given to the charging portion, and thus this method cannot be considered as a sufficient countermeasure.

SUMMARY OF THE INVENTION

The present invention has been accomplished in order to solve the above problems, and an object of the present invention is to provide an image forming apparatus capable of always forming good images, a control method thereof, and a process cartridge.

A further object of the invention is to provide an image forming apparatus capable of forming good images from the early stage of use of a process cartridge detachably attachable to the image forming apparatus and capable of always forming good images at a start of use even after a long unused period of the process cartridge, a control method thereof, and the process cartridge.

An image forming apparatus according to the present invention is an image forming apparatus to which a process cartridge including an image bearing body, developing means provided with a developer containing portion for containing a developer and a developer carrying body for supplying the developer to the image bearing body, and memory means is detachably attachable, the image forming apparatus comprising: determining means which determines a state of use of the process cartridge, based on information stored in the memory means; and charge giving means which gives charge to the developer in the developing means, in a state in which the image bearing body is charged and elimination of charge is not effected on the image bearing body, according to the result of the determination by the determining means.

Another image forming apparatus according to the present invention is an image forming apparatus to which a process cartridge including an image bearing body, charging means for charging the image bearing body, and memory means is detachably attachable, the image forming apparatus comprising: determining means which determines a state of use of the process cartridge, based on information stored in the memory means; and supplying means which supplies electroconductive charging accelerating particles to a charging portion comprised of the image bearing body and the charging means, according to the result of determination by the determining means.

Still another image forming apparatus according to the present invention is an image forming apparatus to which a process cartridge including an image bearing body, developing means provided with a developer containing portion for containing a developer and a developer carrying body for supplying the developer to the image bearing body, charging means for charging the image bearing body, and memory means is detachably attachable, the image forming apparatus comprising: determining means which determines a state of use of the process cartridge, based on information stored in the memory means; supplying means which supplies electroconductive charging accelerating particles to a charging portion comprised of the image bearing body and the charging means, according to the result of the determination by the determining means; and charge giving means which gives charge to the developer in the developing means in a state in which the image bearing body is charged and elimination of charge is not effected on the image bearing body.

A process cartridge according to the present invention is a process cartridge detachably attachable to an image forming apparatus, the process cartridge comprising: an image bearing body; developing means provided with a developer containing portion for containing a developer and a developer carrying body for supplying the developer to the image bearing body; and memory means having an area for storing information used for a determination on whether to carry out an initial operation for giving charge to the developer, in a state in which the image bearing body is charged and elimination of charge is not effected on the image bearing body.

Another process cartridge according to the present invention is a process cartridge detachably attachable to an image forming apparatus, the process cartridge comprising: an image bearing body; charging means which charges the image bearing body; and memory means having an area for storing information used for a determination on whether to carry out an initial operation for supplying electroconductive charging accelerating particles to a charging portion comprised of the image bearing body and the charging means.

Still another process cartridge according to the present invention is a process cartridge detachably attachable to an image forming apparatus, the process cartridge comprising: an image bearing body; developing means provided with a developer containing portion for containing a developer and a developer carrying body for supplying the developer to the image bearing body; charging means which charges the image bearing body; and memory means having an area for storing information used for a determination on whether to carry out an initial operation for supplying electroconductive charging accelerating particles to a charging portion comprised of the image bearing body and the charging means and giving charge to the developer in the developing means, in a state in which the image bearing body is charged and elimination of charge is not effected on the image bearing body.

A control method of image forming apparatus according to the present invention is a method of controlling an image forming apparatus to which a process cartridge including an image bearing body, developing means provided with a developer containing portion for containing a developer and a developer carrying body for supplying the developer to the image bearing body, and memory means is detachably attachable, the method comprising: a first step of mounting the process cartridge on the image forming apparatus; a second step of determining a state of use of the process cartridge, based on information stored in the memory means; and a third step of carrying out an initial operation for giving charge to the developer in the developing means, in a state in which the image bearing body is charged and elimination of charge is not effected on the image bearing body, based on the result of a determination on the state of use of the process cartridge in the second step.

Another control method of image forming apparatus according to the present invention is a method of controlling an image forming apparatus to which a process cartridge including an image bearing body, charging means for charging the image bearing body, and memory means is detachably attachable, the method comprising: a first step of mounting the process cartridge on the image forming apparatus; a second step of determining a state of use of the process cartridge, based on information stored in the memory means; and a third step of carrying out an initial operation for supplying electroconductive charging accelerating particles to a charging portion comprised of the image bearing body and the charging means, based on the result of the determination on the state of use of the process cartridge in the second step.

Still another control method of image forming apparatus according to the present invention is a method of controlling an image forming apparatus to which a process cartridge including an image bearing body, developing means provided with a developer containing portion for containing a developer and a developer carrying body for supplying the developer to the image bearing body, charging means for charging the image bearing body, and memory means is detachably attachable, the method comprising: a first step of mounting the process cartridge on the image forming apparatus; a second step of determining a state of use of the process cartridge, based on information stored in the memory means; and a third step of carrying out an initial operation for supplying electroconductive charging accelerating particles to a charging portion comprised of the image bearing body and the charging means and giving charge to the developer in the developing means, in a state in which the image bearing body is charged and elimination of charge is not effected on the image bearing body, based on the result of determination on the state of use of the process cartridge in the second step.

Further objects of the present invention will become apparent from the following detailed description of the invention with reference to the accompanying drawings.

DESCRIPTION OF THE PREFERRED EMBODIMENTS

Embodiment 1

Figure 1:
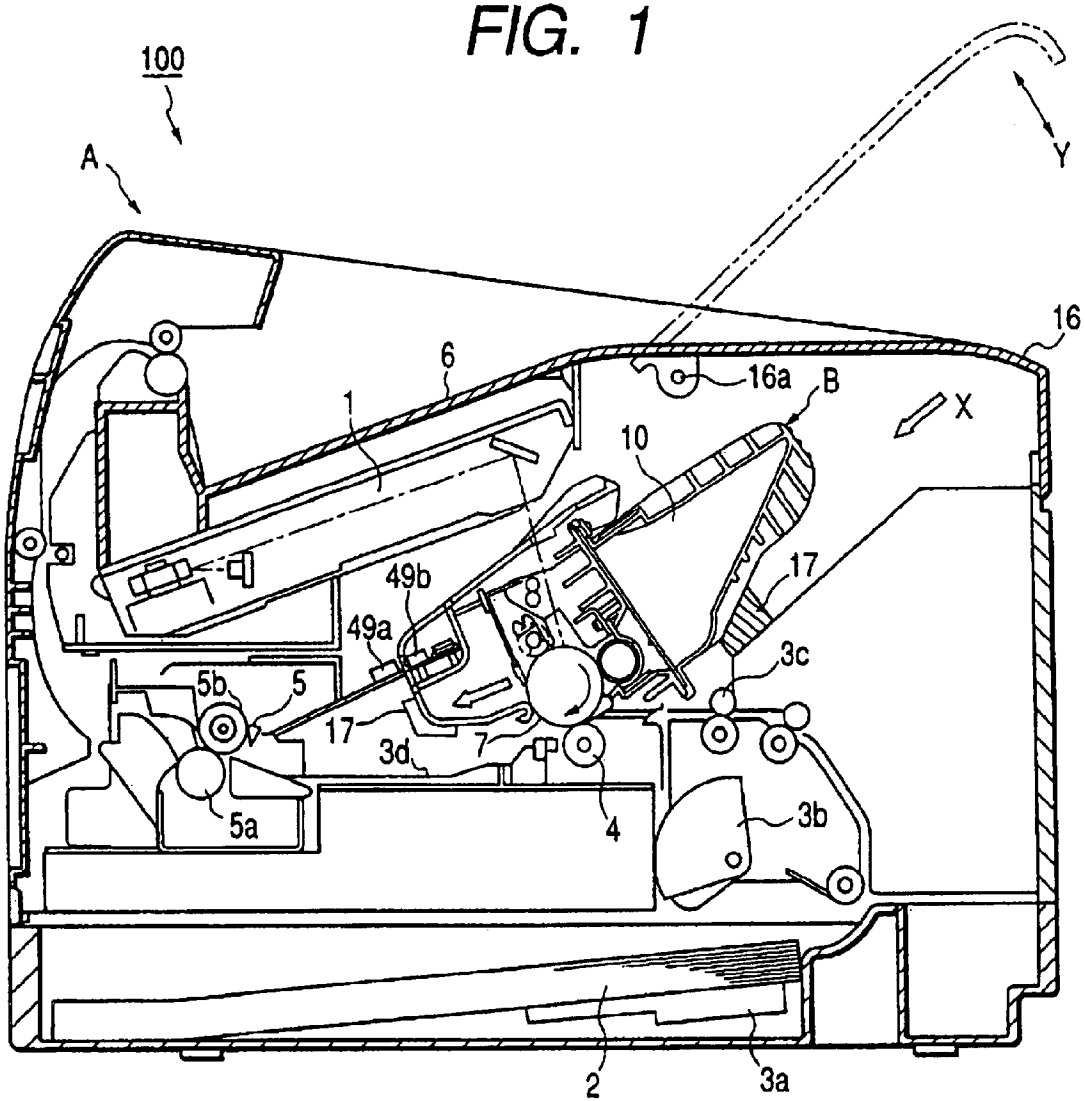
FIG. 1 is a schematic sectional view of an embodiment of the image forming apparatus loaded with the process cartridge according to the present invention.
Figure 2:
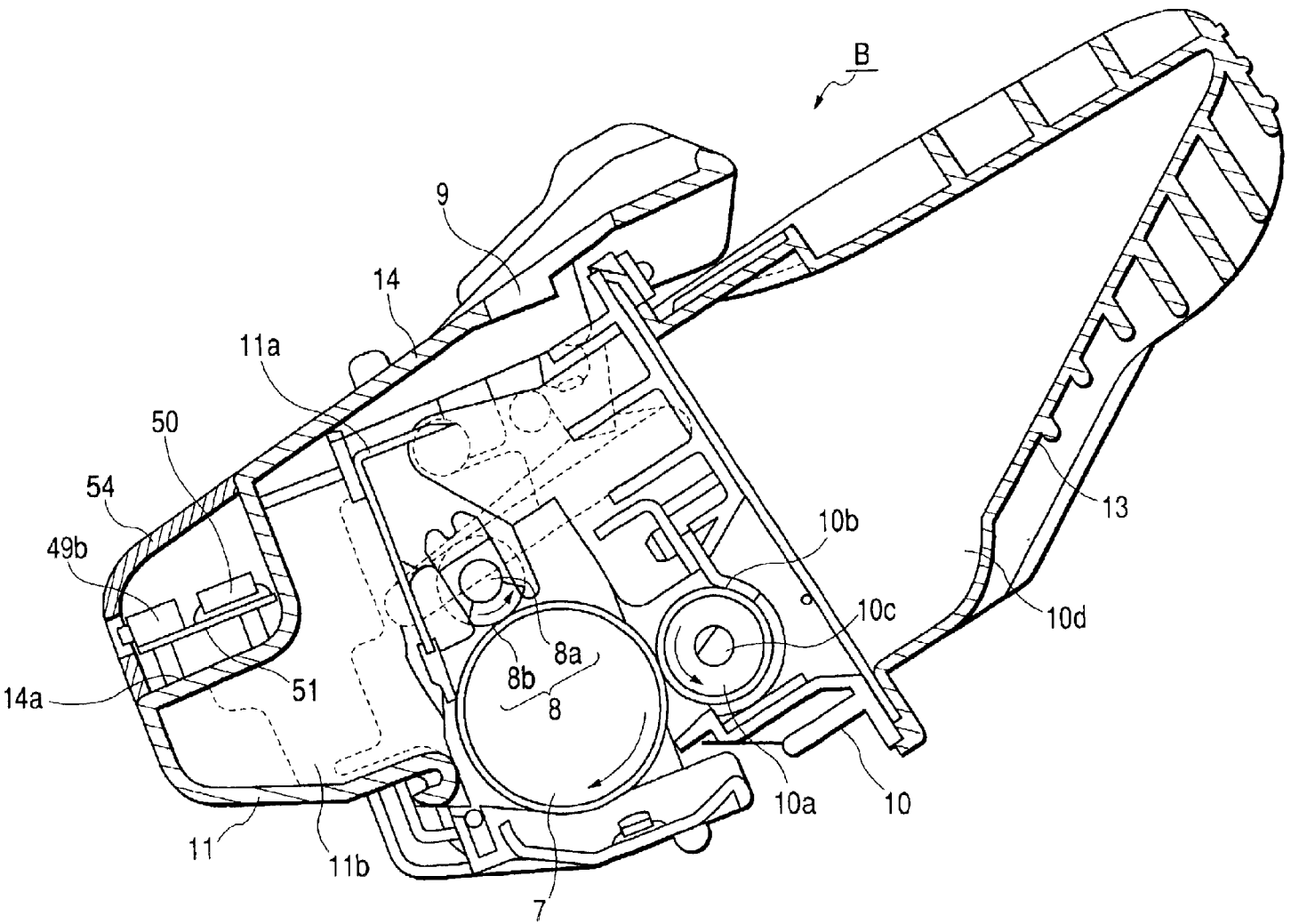
FIG. 2 is a schematic, sectional view of the process cartridge mounted on the image forming apparatus of FIG. 1.

FIG. 1 is a schematic, sectional view of an embodiment of the image forming apparatus according to the present invention. In the present embodiment, the image forming apparatus 100 is a laser beam printer which forms an image by the electrophotographic method on a recording material, e.g., on a recording sheet, an OHP sheet, or the like according to image information sent from an external device, e.g., a host computer or the like. FIG. 2 is a schematic, sectional view of the process cartridge B detachably mounted on the main body A of the image forming apparatus 100 shown in FIG. 1.

A significant feature of the image forming apparatus 100 of the present embodiment is that an early stage of use of the process cartridge B or an unused state thereof over a long period of time is detected and an initial operation is carried out at the start of image formation, in order to overcome the various problems occurring in the case of the process cartridge in the early stage of use or in the unused state over a long period of time.

First, the overall structure of the image forming apparatus 100 loaded with the process cartridge B will be described with reference to FIGS. 1 and 2.

The image forming apparatus 100 is provided with an electrophotographic, photosensitive body of cylindrical shape, i.e., a photosensitive drum 7 as an image bearing body. The photosensitive drum 7 is rotationally driven in a direction indicated by an arrow in the drawing and the surface of the photosensitive drum 7 is uniformly charged by a contact charging member of a roller shape (charging roller) 8 as charging means. In the present embodiment, the charging roller 8 as charging means is an elastic roller in which a flexible member layer 8*b* of a rubber or foam body is formed on a core 8*a*. The charging roller 8 rotatable in a direction indicated by an arrow in the drawing is placed in contact with the photosensitive drum 7 as a body to be charged. A predetermined charging bias is applied from a charging bias applying power source (not shown) to the core 8*a* of the charging roller 8.

The charged photosensitive drum 7 is exposed to an optical image based on image information from an optical system (scanner unit) 1 as exposure means to eliminate charge on the photosensitive drum 7 (elimination of charge), thereby forming an electrostatic, latent image. Then the electrostatic, latent image formed on the photosensitive drum 7 is developed with a developer (toner) by the developing means (developing device) 10 to visualize the latent image into a toner image.

In the present embodiment, the developing device 10 is a reversal developing device using magnetic one-component insulating toner (negative toner). The developing device 10 contains a developing agent containing the toner and charging accelerating particles in a developer container 10*d* as a developer containing portion. The developing device 10 has a developing roller 10*a*, which is a nonmagnetic sleeve provided with a fixed magnet roll 10*c* inside, as a developer carrying body. A developer layer thickness regulating member of a blade shape (developing blade) 10*b* is set in contact with the developing roller 10*a*. Then, the developer contained in the developer container 10*d* is supplied onto the developing roller 10*a* by a magnetic field of the magnet roll 10*c*, the thickness of the developer layer is regulated thereafter by the developing blade 10*b*, and the developer layer is given charge by frictional charging by rubbing the developing roller 10*a* against the developing blade 11*b*. The developer carried on the developing roller 10*a* is carried to a developing portion, which is comprised of opposed portions of the photosensitive drum 7 and the developing roller 10*a*, with rotation of the developing roller 10*a*. A developing bias voltage is applied from a developing bias applying power source (not shown) to the developing roller 10*a*. In the present embodiment, a superimposed voltage of a dc voltage and an ac voltage is used as the developing bias voltage. This causes the developer to be transferred onto the photosensitive drum 7 in accordance with the electrostatic, latent image formed on the photosensitive drum 7, whereby the latent image is visualized into a toner image.

On the other hand, in synchronism with the formation of the toner image on the photosensitive drum 7, a recording material 2 is supplied to a transferring portion where the photosensitive drum 7 is opposed to transferring means 4, by recording material conveying means (sheet feeding mechanism) including a lifter 3*a*, a recording material supplying roller 3*b*, a registration roller pair 3*c*, and so on.

The toner image formed on the photosensitive drum 7 in this way is transferred onto the recording material 2 by the transferring roller 4 kept in contact with the photosensitive drum 7 through the recording material 2, as the transferring means. After that, the recording material 2, onto which the toner image was transferred, is conveyed to fixing means 5 by conveying means 3*d*. The fixing means 5 fixes the transferred toner image on the recording material 2 under heat and pressure by pressing roller 5*a* and fixing roller 5*b*. After that, the conveying means 3*d* discharges the recording material 2 onto a discharging portion 6 provided in the upper part of the main body A of the apparatus.

After the transferring operation of the toner image onto the recording material 2, the surface of the photosensitive drum 7 is cleaned by cleaning means 11, so as to be get ready for the next image formation operation. Namely, the cleaning means 11 scrapes off the toner remaining on the photosensitive drum 7 by a cleaning blade 11*a* and collects the toner thus scraped off, into a toner reservoir 11*b*.

In the present embodiment, as shown in FIG. 2, the process cartridge B is comprised of the photosensitive drum 7 and, the charging means 8, developing means 10, and cleaning means 11 as process means acting on the photosensitive drum 7. The developing device 10 provided with the developing roller 10*a*, the developer regulating blade 10*b*, and the developer container 10*d* is integrated into a unit by a developing frame 13 to form a developing unit. The photosensitive drum 7, the charging means 8, and the cleaning means 11 are integrated into a unit by a cleaner container frame or cleaning frame 14 to form a cleaning unit. Then, the developing frame 13 and the cleaner container frame 14 are integrally coupled to each other to form the process cartridge B detachably attachable to the main body A of the apparatus. The process cartridge B is provided with an exposure portion 9, which is an aperture portion for letting an optical image in from the optical system 1 to illuminate the surface of the charged photosensitive drum 7.

The process cartridge B is mounted in a detachable state onto the main body A of the apparatus in such a way that an opening/closing cover 16 of the main body A is opened in a direction indicated by an arrow in FIG. 1 about the center on an axis 16*a*, then the cartridge is inserted in a direction indicated by an arrow X in the same figure, and the cartridge is set through mount means 17 in the main body A.

Figure 3:
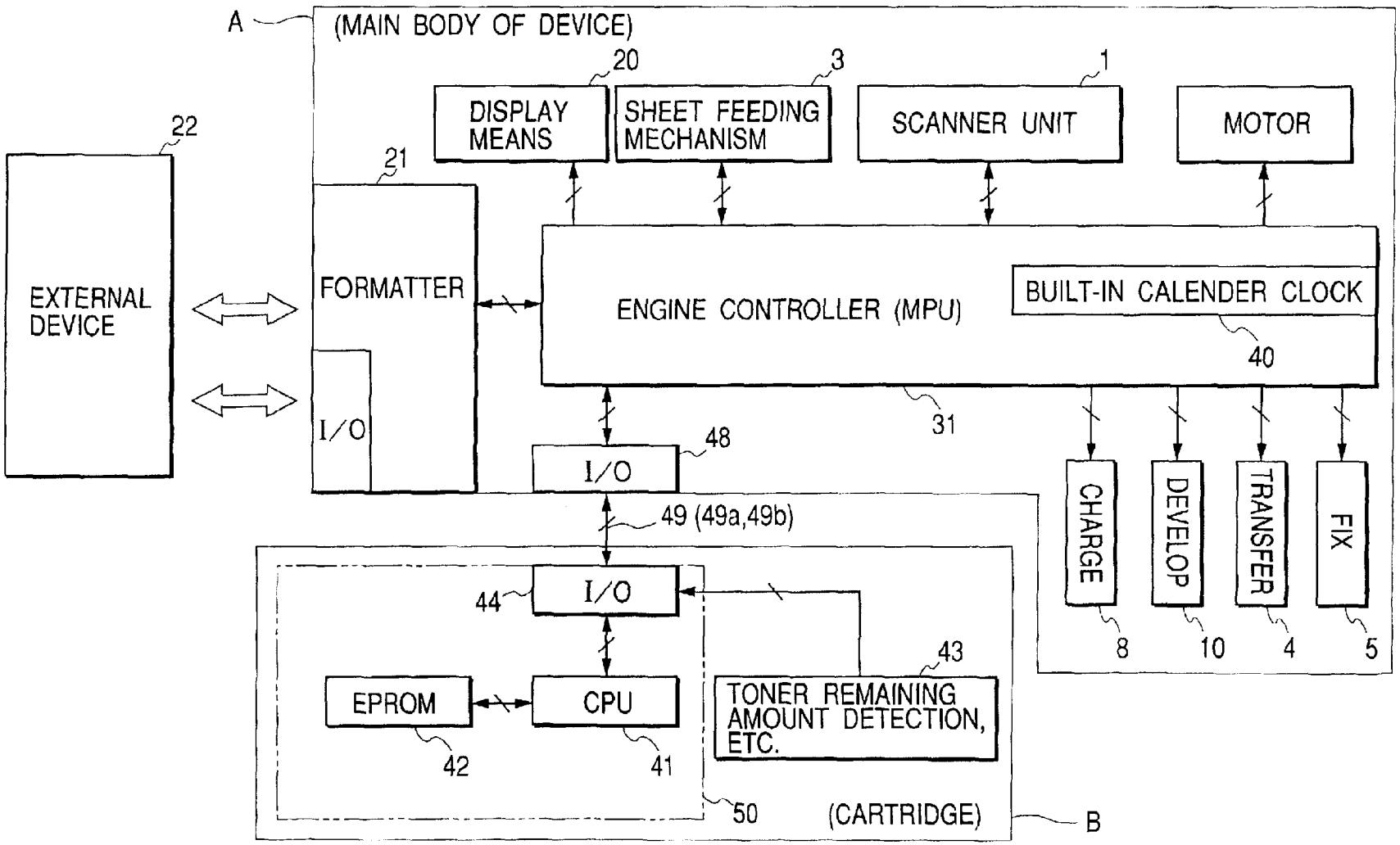
FIG. 3 is a control block diagram of the image forming apparatus of FIG. 1.

FIG. 3 is a simplified control block diagram of the main body A of the image forming apparatus and the process cartridge B, which shows only portions associated with implementation of the present invention.

In FIG. 3, a portion surrounded by a chain double-dashed line represents a cartridge-side control circuit 50 mounted on the process cartridge B. At the same time as the process cartridge B is mounted on the main body A of the image forming apparatus, the cartridge-side control circuit 50 mounted on the process cartridge B is connected to the main body A of the apparatus at I/O connector portion 49.

When an input/output device (I/O port) 48 is connected to an input/output device (I/O port) 44 on the cartridge side through the I/O connector portion 49 consisting of an apparatus-side I/O connector portion 49*a* and a cartridge-side I/O connector portion 49*b*, an engine controller (MPU) 31, being a control portion mounted on the main body A of the apparatus, becomes able to make reference to data from a cartridge-side arithmetic device (CPU) 41 and from cartridge-side sensors 43 including developer remaining amount detecting means and others.

The process cartridge B can be provided with a toner amount sensor of one of the known light transmitting method, the pressure sensing method, the capacitance measuring method, and so on as the developer remaining amount detecting means. For example, a toner amount sensor of the capacitance measuring method is a sensor making use of the phenomenon that the capacitance between electrodes varies depending upon the amount of toner; a voltage is applied to the input electrode and an output signal from an output electrode is sent, for example, as a voltage value to the side of the main body A. The main body A of the apparatus can detect a toner end by comparing the voltage output value with a predetermined threshold or can sequentially detect the amount of toner by arithmetic control with a table, an arithmetic equation, or the like preliminarily determined as to the relationship between output voltage values and toner remaining amounts. Since the developer remaining amount detecting means of the capacitance measuring method or the aforementioned light transmitting method and pressure sensing method all are publicly known, further description thereof is omitted herein. It is a matter of course that the present invention does not limit the developer remaining amount detecting means to specific methods and any developer remaining amount detecting means can be applied.

The engine controller 31 is connected in a communicable state to an external device 22 such as a host computer or the like through an interface portion (formatter and I/O port) 21. A print command signal and an image information signal from the external device 22 are supplied through the interface portion 21 to an unillustrated video control portion, and the video control portion outputs the print command signal and video signal to the engine controller 31. The engine controller 31 performs the image forming operation by controlling the sheet feeding mechanism 3, the scanner unit 1, the charging means 8, the developing means 10, the transferring means 4, the fixing means 5, motors of various driving systems, etc. on the basis of the print command signal and the video signal.

The engine controller 31 is connected to display means 20, e.g., a liquid crystal display panel, an LED warning lamp, and the like provided in the main body A and sends a signal for an indication of warning or the like to the display means 20 according to necessity, as detailed hereinafter. Further, the engine controller 31 can also send the above signal for the indication of warning or the like to the external device 22 through the interface portion 21. This permits the indication of warning or the like to be displayed on a display screen or the like of the external device 22.

The cartridge-side control circuit 50 provided on the process cartridge B is loaded with a memory device (hereinafter referred to simply as "memory") 42 being memory means capable of storing electronic information. In the present embodiment, a rewritable EP-ROM is used as the memory 42. In the present embodiment, the input/output device 44 for input/output between the main body A and the cartridge-side arithmetic unit 41 is a serial port, for example, in order to avoid failure in contact between contact points, thereby decreasing the number of contact points.

The cartridge-side control circuit 50 can be mounted, for example, on the process cartridge B, as shown in FIG. 2. The cartridge-side control circuit 50 can be set at any position in the process cartridge B, and in the present embodiment the cleaner container frame 14, which is a fixed frame as a positioning reference to the main body A of the image forming apparatus, is selected for setting the control circuit 50. The control circuit 50 is located at the distal end of the cleaning frame 14 which is most distant from the portions generating discharge noise, such as the charging means 8, the transferring unit 4, and so on.

In the present embodiment, as shown in FIG. 2, a step portion 14*a* is formed at the distal end of the cleaner container frame 14 in the inserting direction X of the process cartridge B onto the main body A of the apparatus, a cartridge-side control circuit board 51 equipped with the electronic devices (cartridge-side control circuit) 50 and cartridge-side I/O connector portion 49*b* is mounted on the step portion 14*a*, and the region around the step portion 14*a* is covered by a cover 54 to protect it.

FIG. 3 shows a state in which the process cartridge B with the cartridge-side control circuit 50 is mounted on the main body A of the apparatus. When the process cartridge B is mounted on the main body A of the apparatus, the cartridge-side I/O connector portion 49*b* is coupled to the apparatus-side I/O connector portion 49*a*, thus forming the I/O connector portion 49. These connector portions 49*a*, 49*b* are configured so as to be coupled in the process of the mounting operation of the process cartridge B.

In the present embodiment, the following data is stored in the memory 42 of the process cartridge B. The contents of the data stored in the memory 42 are generally categorized under three kinds of data classes (a), (b), and (c) by their features.

Data class (a):

lot number, manufacturing date, manufacturing plant, characteristic values of each unit (characteristics of the charging roller, characteristics of the photosensitive drum, etc.), main body compatibility code, and quality retention time limit Data class (b):

used/unused (new), and use start date and time

Data class (c):

usable media sizes, number of sheets used, result of detection of toner remaining amount, and final use date and time.

Namely, the data class (a) includes data stored at the time of manufacturing of the process cartridge B, such as the manufacturing lot number, the manufacturing date, etc., of the process cartridge B, and the data will be read by the main body A of the apparatus and will not be rewritten. The data class (b) includes data such as used/unused information indicating whether use of the process cartridge B is started, the use start date, etc., and the data will be written (updated) only once through communication with the main body A of the apparatus. Namely, in the case that the cartridge is once used, information of "used" is recorded and a date at that time is written as data from a calendar 40, built in the engine controller (MPU) 31 in the main body A of the apparatus, into the memory 42 of the process cartridge B. This data is data that can be written only once. The data class (c) includes data which will be updated for every image forming operation, such as the final use date and time of the process cartridge B, the number of images formed by the use of the process cartridge B up to that point, and so on.

FIG. 3 shows the configuration in which the calendar clock is disposed in the engine controller 31, but the position of the calendar clock is not limited to this configuration; for example, the calendar clock may be disposed in the formatter 21.

The following will describe the determination on the early stage and long-period nonoperation, and the initial operation of the cartridge.

Figure 4:
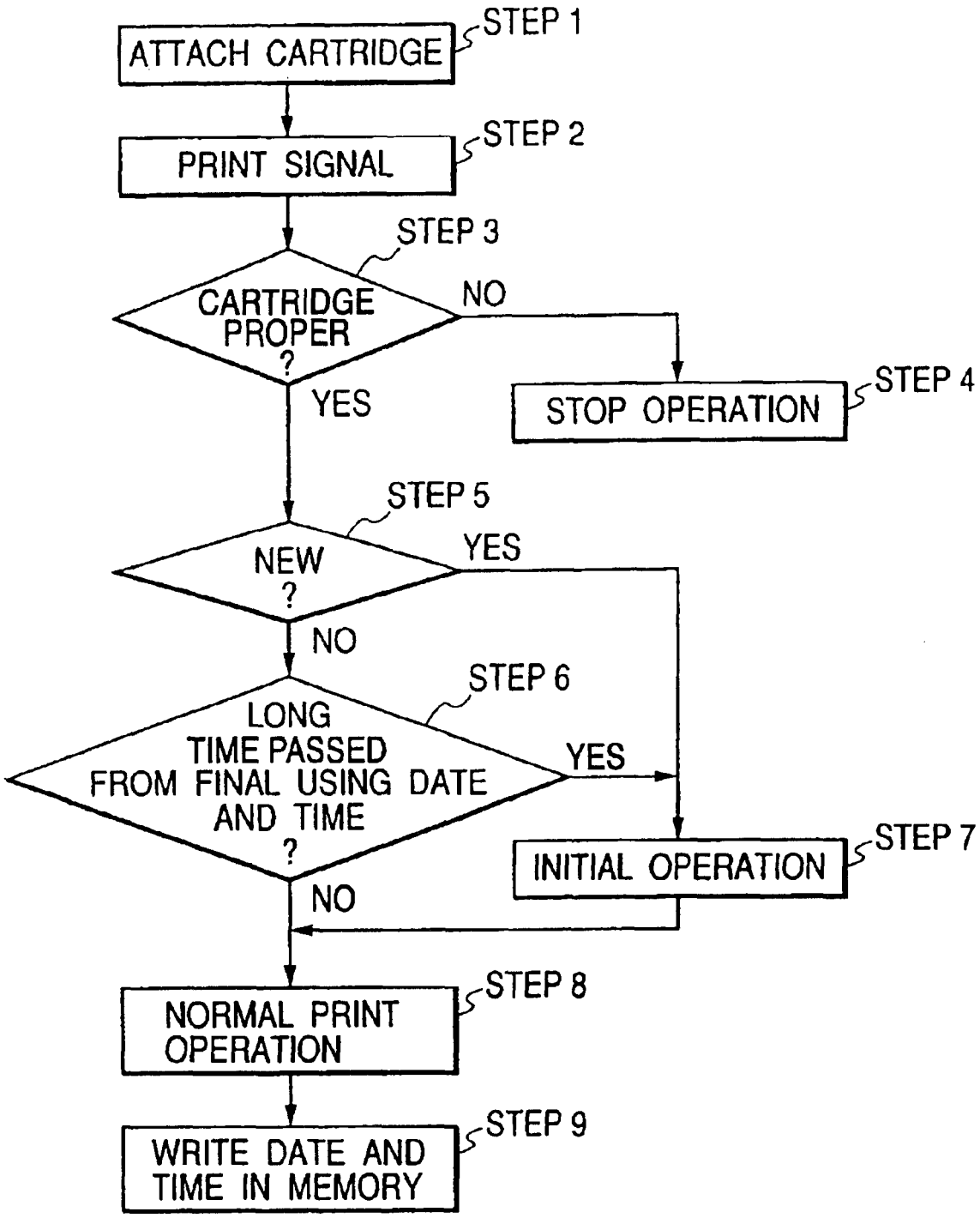
FIG. 4 is a flowchart for explaining an embodiment of the control procedure of the initial operation according to the present invention.

The operation upon actual formation of an image will be described with reference to the flowchart of FIG. 4. FIG. 4 shows the simplified operation procedure characteristic of the present invention in order to facilitate the understanding of the present invention, but it is to be understood that the present invention is by no means intended to be limited to only this procedure.

The process cartridge B is mounted on the main body A of the apparatus (step 1). Receiving a print signal (step 2), the engine controller 31 in the main body A of the apparatus makes reference to the information stored in the memory 42 of the process cartridge B, for example, to read the main body compatibility code indicating the kind of the process cartridge B and check whether the process cartridge B is compatible with the main body of the apparatus, thereby determining whether the process cartridge B is usable. The engine controller 31 also reads the quality retention time limit of the process cartridge B and compares it with the present date to check whether the present date is within the quality retention time limit, thereby determining whether the process cartridge B is usable (step 3). When the process cartridge B is judged unusable, the print operation is stopped and the signal for the indication of warning or the like is sent to the display means 20 or the like in order to inform the user of the information indicating the stopping of the print operation (step 4).

When it is determined in the determination at step 3 that the process cartridge B is usable as a result of the determination on the kind of the process cartridge B, the quality retention time limit, etc., the controller accesses the memory 42 of the process cartridge B to read the used/unused information of the process cartridge B and determine whether the mounted process cartridge B is new or not (step 5). When the process cartridge B is new, the predetermined initial operation detailed hereinafter is carried out (step 7) and thereafter the apparatus goes into the print operation (step 8).

When it is determined at step 5 that the process cartridge B is not new on the other hand, the controller then reads the date and time (final use date and time) when the process cartridge B was used last in the previous operation, from the memory 42, to determine whether a long time has passed until now (step 6). When it is determined that a long time has passed, the predetermined initial operation described hereinafter is carried out (step 7) and thereafter the apparatus performs the print operation (step 8). When it is determined at step 6 that a long time has not passed yet, the apparatus goes directly into the print operation (step 8).

After completion of the print operation thereafter, the current date and time is stored as the final use date and time in the memory 42 of the process cartridge B (step 9).

In the present embodiment, as the initial operation carried out according to necessity, the following initial operation (pre-processing) is carried out to give a sufficient amount of charge by frictional charging to the toner in the developing device 10, in order to be ready for cases where the charge by frictional charging with the developing roller 10*a* and developing blade 10*b* is insufficient because of the early stage of use of the process cartridge B or the long-period nonoperation thereof.

Namely, the present embodiment adopts the reversal developing in which the toner charged to a negative polarity is attached to portions with the charge of the negative polarity attenuated by the exposure of the photosensitive drum 7 uniformly charged to the negative polarity. First, the surface of the photosensitive drum 7 is uniformly charged to the negative polarity by the charging means 8 and thereafter the developing bias is applied to the developing roller 10*a*, without carrying out the exposure by the scanner unit 1. Further, the photosensitive drum 7, the developing roller 10*a*, etc., are rotated without the supply of the recording material 2. With this rotation, the toner is rubbed against the developing roller 10*a* and the developing blade 10*b* to be charged to the negative polarity by frictional charging.

The execution of the initial operation as described above can solve the problem that the density becomes low, particularly, under high humidity circumstances resistant to frictional charging because the toner is without charge in the new process cartridge B or because the toner in the process cartridge B is unused over a long period of time.

The determination on whether to carry out the initial operation in the present embodiment described above was to determine whether the process cartridge B was used from the unused state or whether use of the process cartridge B was stopped over a long period of time. Further, it is also possible to employ a configuration wherein it is determined whether the process cartridge B is in an early stage of use within a predetermined range from a start of use, for example, it is determined how many images were formed since the start of use by the process cartridge B from the information in the memory 42 provided in the process cartridge B and the initial operation is carried out in the case of the process cartridge in the early stage.

As described above, the present embodiment employs the configuration wherein the process cartridge B is loaded with the memory 42 storing the various information and being capable of exchanging information with the main body A of the apparatus and wherein the operation of giving sufficient charge to the toner is carried out when it is determined that the process cartridge B is in the early stage of use, whereby good images can be formed from the early stage of use. Since the charge on the toner is conceivably attenuated after a long unused period of the process cartridge B, the present embodiment is arranged in the configuration wherein the time of previous use of the process cartridge B is stored in the memory 42 and wherein the initial operation of giving charge to the toner is carried out in the case of the process cartridge unused over a long period of time. This permits the apparatus to form good images constantly.

As described above, the present embodiment can solve the problem that the density becomes low in the case when the process cartridge B is in the early stage of use or in a long-period unused state. In addition, the initial operation of giving sufficient charge to the toner by frictional charging in order to increase the density of the image does not have to be carried out on unnecessary occasions, e.g., at every formation of an image, so that it is feasible to prevent the inconvenience that the time for formation of the first image (first print time) becomes longer than necessary, for example.

Embodiment 2

The following will describe another embodiment of the image forming apparatus to which the process cartridge according to the present invention is detachably attachable.

The image forming apparatus of the present embodiment has the structure approximately similar to that in Embodiment 1, but the apparatus of the present embodiment carries out the electrophotographic image forming process employing the contact charging method, the transferring method, and the toner recycle process (cleanerless system), as disclosed in Japanese Patent Application Laid-Open No. 10-307455.

In the image forming apparatus of the present embodiment (image forming apparatus), the charging accelerating particles mixed in the toner in the developing device 10 are supplied via the surface of the photosensitive drum 7 to the charging means 8 during the print operation. In the configuration of the present embodiment, a relatively simple member such as a charging roller, a fur brush, or the like, being a contact charging member, is used as the charging means and the method of mixing the charging accelerating particles in the toner in the developing device 10 is employed, whereby stable charging processing can be implemented simply and highly efficiently.

Figure 5:
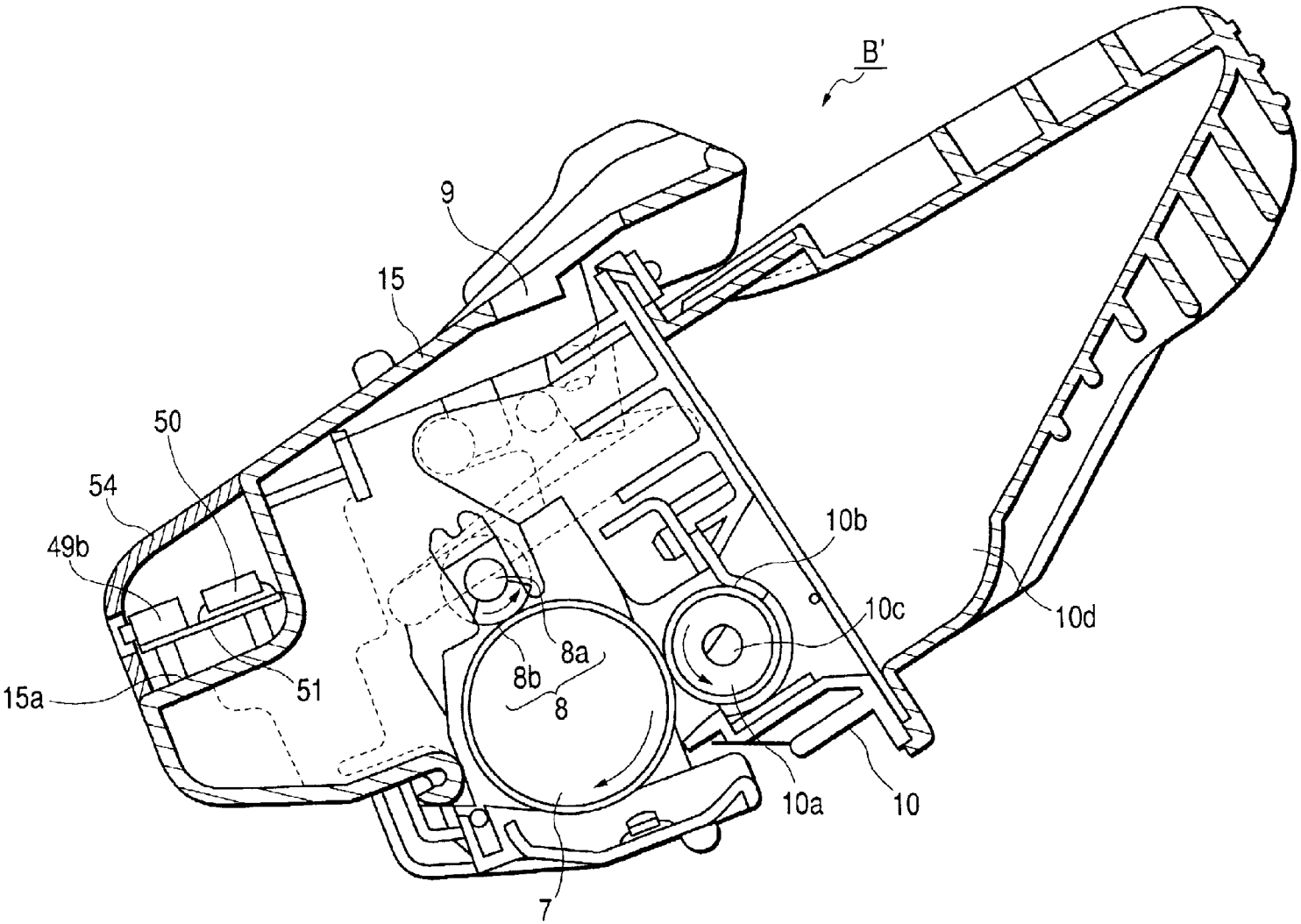
FIG. 5 is a schematic, sectional view of another embodiment of the process cartridge detachably attachable to the image forming apparatus according to the present invention.

FIG. 5 is a schematic, sectional view of the process cartridge B' which is detachably attachable to the image forming apparatus of the present embodiment. The structure of the main body of the apparatus can be similar to that of the image forming apparatus 100 in Embodiment 1. In the present embodiment, elements having the functions and configurations similar to those in the image forming apparatus 100 in Embodiment I will be denoted by the same reference symbols and a detailed description thereof will be omitted.

In the present embodiment, the charging roller 8 as the charging means is an elastic roller in which the flexible member layer 8*b* as a rubber or foam body is formed on the core 8*a*. The charging roller 8 is arranged to be pressed against the photosensitive drum 7 as a body to be charged, and a contact nip portion between them forms a charging portion. The charging roller 8 can be rotated by following the rotation of the photosensitive drum 7, or can be rotationally driven with a difference in peripheral speed. The predetermined charging bias is applied from a charging bias applying power source (not shown) to the core 8*a* of the charging roller 8. In the present embodiment, a dc voltage is applied as the charging bias.

In the present embodiment, the developing device 10 is a reversal developing device using magnetic one-component insulating toner (negative toner). The developing device 10 contains a developing agent (developer) containing the toner and the charging accelerating particles, in the developer container 10*d*. The developing device 10 has the developing roller 10*a* of a nonmagnetic sleeve provided with the fixed magnet roll 10*c* inside, as the developer carrying body. The developer layer thickness regulating member of a blade shape (developing blade) 10*b* is kept in contact with the developing roller 10*a*. Then the developer contained in the developer container 10*d* is supplied onto the developing roller 10*a* by the magnetic field of the magnet roll 10*c*, the layer thickness is regulated thereafter by the developing blade 10*b*, and the toner layer is rubbed against the developing roller 10*a* and the developing blade 10*b* to be provided with charge by frictional charging. The developer carried by the developing roller 10*a* is carried to the developing portion, which is comprised of the opposed portions of the photosensitive drum 7 and the developing roller 10*a*, with rotation of the developing roller 10*a*. The developing bias voltage is applied from the developing bias applying power source (not shown) to the developing roller 10*a*. In the present embodiment, the developing bias voltage is a superimposed voltage of a de voltage and an ac voltage. This causes the developer to be transferred onto the photosensitive drum 7 according to the electrostatic, latent image formed thereon, thereby visualizing the latent image into a toner image.

As described above, the image forming apparatus of the present embodiment is constructed in a cleanerless structure. Namely, the after-transfer residual toner remaining on the photosensitive drum 7 after the transferring operation of the toner image onto the recording material 2 is carried via the charging portion to the developing portion with rotation of the photosensitive drum 7, without being removed by the cleaning means 11 used in the image forming apparatus 100 of Embodiment 1, and is subjected to cleaning simultaneous with developing (collection) in the developing device 10.

In the present embodiment, the charging accelerating particles are mixed with the toner as the developer and they are contained in the mixed state in the developing device 10. The electroconductive charging accelerating particles mixed in the developer contained in the developing device 10 are normally transferred by an appropriate amount together with the toner onto the photosensitive drum 7 during the developing operation for developing of the electrostatic, latent image on the photosensitive drum 7 by the developing device 10. The toner image on the photosensitive drum 7 is actively transferred onto the recording material 2 through the action of the transferring bias applied to the transferring means 4 in the transferring nip portion. However, since the charging accelerating particles on the photosensitive drum 7 are electrically conductive, they are not actively transferred onto the recording material 2, but remain as substantially attached and retained on the photosensitive drum 7.

In the present embodiment, the charging accelerating particles are electroconductive zinc oxide particles. The charging accelerating particles are charged to a positive polarity by friction against the toner and others. The image forming apparatus of the present embodiment employs reversal developing in which the toner charged to a negative polarity is attached to portions with the charge of the negative polarity attenuated by the exposure of the photosensitive drum 7 uniformly charged to the negative polarity to effect development, as in Embodiment 1. This causes the charging accelerating particles charged to the positive polarity to be transferred onto the photosensitive drum 7 charged to the negative polarity, in the developing portion where the photosensitive drum 7 and the developing roller 10*a* are opposed to each other. After that, the charging accelerating particles are transferred onto the charging portion with the stronger charge of the negative polarity, thereby functioning as an aid to charging in the charging portion.

As described above, the after-transfer residual toner and the remaining charging accelerating particles remaining on the photosensitive drum 7 after the transferring operation are carried in that state with rotation of the photosensitive drum 7 to the charging nip portion between the photosensitive drum 7 and the charging roller 8 as the contact charging member with the cleanerless (toner recycle process) configuration. Then, they are attached and mixed onto the charging roller 8. Accordingly, the contact charging is effected on the photosensitive drum 7 in a state in which the charging accelerating particles are present in the nip portion between the photosensitive drum 7 and the charging roller 8.

The after-transfer residual toner attached and mixed onto the charging roller 8 is gradually transferred from the charging roller 8 onto the photosensitive drum 7 to be carried to the developing portion with movement of the surface of the photosensitive drum 7, and is subjected to cleaning simultaneous with developing (collection) in the developing device 10.

The cleaning simultaneous with developing is a process of collecting the toner remaining on the photosensitive drum 7 after the transferring operation by an antifogging bias of the developing device 10, i.e., an antifogging potential difference being a potential difference between the dc voltage applied to the developing device 10 and the surface potential of the photosensitive drum 7 during the subsequent developing operation in the image forming process. In the case of the reversal developing method as in the present embodiment, the cleaning simultaneous with developing is implemented by the action of an electric field for transferring the toner from the dark potential on the photosensitive drum 7 onto the developing roller 10*a* to collect it and the electric field for attaching the toner from the developing roller 10*a* to the bright potential on the photosensitive drum 7.

Even if the charging accelerating particles drop off from charging roller 8, the charging accelerating particles mixed in the developer in the developing device 10 transfer onto the surface of the photosensitive drum 7 in the developing portion with operation of the image forming apparatus, are carried via the transferring nip portion to the charging portion with rotation of the photosensitive drum 7, and thus are sequentially supplied continuously to the charging roller 8, whereby a good charging property can be maintained stably by the existence of the charging accelerating particles.

In the present embodiment, the developing roller 10*a*, the developing blade 10*b*, and the developer container 10*d* are integrated into a unit by the developing frame 13 to form a developing unit. The photosensitive drum 7 and the charging roller 8 are integrated into a unit by the drum frame 15 to form a drum unit. Then the developing frame 13 and the drum frame 15 are integrally coupled to each other to constitute the process cartridge B'.

Figure 6:
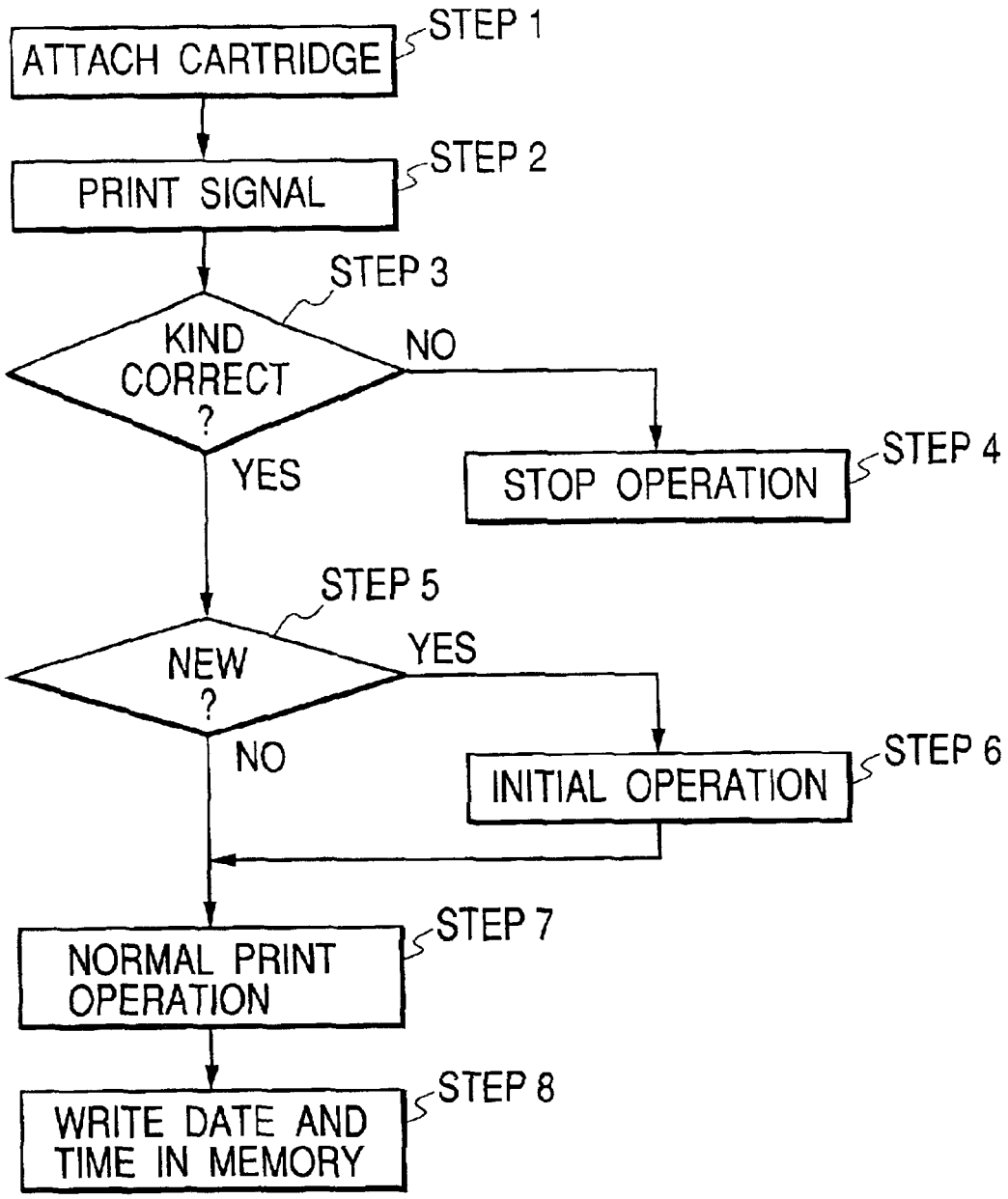
FIG. 6 is a flowchart for explaining another embodiment of the control procedure of the initial operation according to the present invention.

The following will describe the initial operation in the present embodiment. In the present embodiment, the control block associated with the initial operation can be similar to that described in Embodiment 1 with reference to FIG. 3, and the information stored in the process cartridge B' can also be similar to that in Embodiment 1. FIG. 6 shows a flowchart of the control procedure of the initial operation in the present embodiment.

In the method of supplying the charging accelerating particles from the developing device 10 to the charging portion as in the image forming apparatus of the present embodiment, the conventional apparatus suffered the problem of the occurrence of a charging failure in the formation of initial images, because the charging accelerating particles were absent in the charging portion in the case of the process cartridge B' being in the early stage of use. A conceivable solution to this problem is a method of providing the charging portion with some amount of charging accelerating particles in the production stage of the process cartridge B'. In this method, however, there still remains the problem that the charging accelerating particles preliminarily given in the charging portion drop off from the charging portion because of vibration or the like during transportation of the process cartridge B', for example.

In the present embodiment, therefore, a predetermined initial operation for supplying the charging accelerating particles to the charging portion is carried out when it is determined that the process cartridge B' is in the early stage of use.

Namely, in a manner similar to the procedure described in Embodiment 1 with reference to FIG. 4, the process cartridge B' is mounted on the main body of the apparatus, and with reception of a print signal, the control portion (engine controller) 31 in the main body of the apparatus determines whether the process cartridge B' thus mounted is usable (steps 1 to 4). Then, the control portion makes accesses the memory 42 in the process cartridge B' to read the used/unused information of the process cartridge B' and determine whether the mounted process cartridge B' is in the early stage of use (step 5). When it is determined that the process cartridge B' is in the early stage of use, the predetermined initial operation is carried out (step 6) and then the normal print operation is carried out thereafter; or, the normal print operation is carried out directly from step 5 when it is determined that the process cartridge is not in the early stage of use (step 7). Further, after completion of the print operation, the present date and time is stored as the final use date and time in the memory 42 of the process cartridge B' (step 8), as in Embodiment 1.

Here the initial operation carried out in the case of the process cartridge B' being in the early stage of use is the following operation in the present embodiment. Namely, the charging processing on the surface of the photosensitive drum 7 is started in the rotating state of the photosensitive drum 7. At this time, since the charging accelerating particles are absent in the charging portion, the photosensitive drum may be charged with uneven charge or does not have to be charged at the predetermined potential necessary for formation of an image.

When the charging portion on the photosensitive drum 7 then reaches the developing portion, the charging accelerating particles are transferred onto the photosensitive drum by the potential difference. When the developing bias applied to the developing roller 1*a* is set at 0 V at this time, the potential difference becomes larger to the surface of the photosensitive drum 7, whereby a greater amount of charging accelerating particles can be transferred. However, the toner charged to the opposite polarity (positive polarity) existing in part among the toner can also be transferred, and thus a predetermined developing bias may be applied. Then, the charging accelerating particles on the photosensitive drum 7 are transferred to the charging portion with stronger charge of the negative polarity in the charging portion.

According to the investigation by the inventor, the charging accelerating particles necessary for uniform charging can be supplied to the charging portion, normally, by carrying out the initial operation for approximately 30 seconds. This naturally differs depending upon the process speed of the apparatus carrying out the present invention and thus can be properly selected.

If the initial operation as described above is carried out for every print operation without a basis in the information in the memory 42 provided in the process cartridge B', the charging accelerating particles will become short and a large amount of the charging accelerating particles must be preliminarily contained in the developing device 10. However, if a large amount of the charging accelerating particles are mixed in the toner in this way, the developing property can be negatively affected. The execution of the initial operation per print operation also raises the problem of a long first print time. The present embodiment can solve these problems.

It is also possible to carry out the operation of feeding the charging accelerating particles from the interior of the developing device to the charging portion in the case of the process cartridge B' being used over a long period of time, by reading the date and time of the previous operation (final use date and time) from the memory 42 and determining the period of nonoperation of the process cartridge B', as in Embodiment 1.

As described above, the present embodiment employs the configuration wherein the process cartridge B' is equipped with the memory 42 storing the various information and is capable of exchanging information with the main body A of the apparatus and wherein the operation of feeding the charging accelerating particles from the interior of the developing device 10 to the charging portion when the process cartridge B' is judged in the early stage of use, whereby the present embodiment can prevent such inconvenience as a charging failure of the photosensitive drum 7 or the like due to the absence of the charging accelerating particles in the charging portion in the early stage of use of the process cartridge B' even if the charging accelerating particles are absent in the charging portion in the early stage of use of the process cartridge B'. Since the charging accelerating particles do not have to be made preliminarily present in the charging portion as described above, the present embodiment is free of the problem that the charging accelerating particles drop off or leak from the charging portion before use. This permits the apparatus to form good images from the early stage of use of the process cartridge. Further, since the initial operation is carried out according to necessity, the present embodiment also has the advantage of minimizing the amount of the charging accelerating particles mixed in the developer contained in the developing device 10.

In the present embodiment, the supply of the charging accelerating particles to the charging portion was described in particular, but the aforementioned initial operation can be performed in the case of the process cartridge B' being in the early stage of use and in the case of the process cartridge being in the unused state over a long period of time, whereby the toner in the developer can also be provided simultaneously with the charge by frictional charging. Accordingly, the present embodiment can also achieve the effect similar to that in the first embodiment.

The present embodiment described the example where the charging accelerating particles were contained in the developing device 10, but the charging accelerating particles are not limited to those contained in the developing device 10 and may be supplied by another method.

As described above, the image forming apparatus and process cartridge according to the present invention can form good images from the early stage of use of the process cartridge and can always form good images at a start of use even in the case of the process cartridge being in the unused state over a long period of time, whereby they can solve the problem of low density, which used to occur in the early stage of use of the process cartridge or after nonoperation over a long period of time in the conventional apparatus.

In the configuration employing the method of mixing the charging accelerating particles in the developer and supplying the particles to the charging portion of the electrophotographic, photosensitive body according to the present invention, the charging portion does not have to be provided with the charging accelerating particles in the production stage of the process cartridge, so that the present invention can solve the problem that the charging accelerating particles drop off or leak from the charging portion.

Further, the present invention can solve the problem that the time for pre-processing (initial operation) in formation of an image becomes longer than necessary to lengthen the first print time and the problem that the charging accelerating particles have to be confined in an amount more than necessary in the developing device.

It is noted that the present invention is by no means intended to be limited to the above embodiments but the invention can embrace changes and modifications within the same technical concept.

What is claimed is:

1. An image forming apparatus to which a process cartridge is detachably attachable, the process cartridge including (i) an image bearing body, (ii) charging means for charging the image bearing body to a predetermined polarity, (iii) developing means having a developer containing portion configured and positioned to contain a developer and a developer carrying body configured and positioned to supply the developer to the image bearing body, wherein the developer containing portion contains an electroconductive charging accelerating particle of a polarity opposite to the predetermined polarity, and (iv) memory means for storing information, said image forming apparatus comprising:

determining means for determining the state of use of the process cartridge, based on the information stored in the memory means; and a controller configured to permit the developing means to perform an operation of supplying the electroconductive charging accelerating particle to a charging portion on the image bearing body for a predetermined period of time when said determining means determines that the process cartridge is new;

wherein said controller controls the charging means to charge the image bearing body to the predetermined polarity, and thereafter said controller controls the developing means to transfer the electroconductive charging accelerating particle of the polarity opposite to the predetermined polarity from the developer carrying body to the image bearing body to supply the charging portion with the electroconductive charging accelerating particle.

2. An image forming apparatus according to claim 1, wherein, in the memory means, information indicating whether the process cartridge is new or not new is stored, and wherein said determining means determines whether the process cartridge is new, based on the information indicating whether the process cartridge is new or not new.

3. An image forming apparatus according to claim 2, wherein when said determining means determines that the process cartridge is new, said controller controls the developing means to perform the operation of supplying the charging accelerating particle to the charging portion for the predetermined period of time, in a state in which the image bearing body is charged by the charging means and elimination of charge is not effected on the image bearing body.

4. A method of controlling an image forming apparatus to which a process cartridge is detachably attachable, the process cartridge including (i) an image bearing body, (ii) charging means for charging the image bearing body to a predetermined polarity, (iii) developing means having a developer containing portion configured and positioned to contain a developer and a developer carrying body configured and positioned to supply the developer to the image bearing body, wherein the developer containing portion contains an electroconductive charging accelerating particle of a polarity opposite to the predetermined polarity, and (iv) memory means for storing information, said method comprising:

a first step of mounting the process cartridge on the image forming apparatus;

a second step of determining a state of use of the process cartridge, based on the information stored in the memory means; and a third step of carrying out an initial operation for charging the image bearing body by the charging means to the predetermined polarity, and thereafter transferring the electroconductive charging accelerating particle of the polarity opposite to the predetermined polarity from the developer carrying body to the image bearing body to supply a charging portion on the image bearing body with the electroconductive charging accelerating particle for a predetermined period of time when said second step determines that the process cartridge is new.

5. A method according to claim 4, wherein the information stored in the memory means is information indicating whether the process cartridge is new or not, said method further comprising a fourth step of carrying out the initial operation for the predetermined period of time when it is determined in said second step that the process cartridge is new, and carrying out an image forming operation without carrying out the initial operation when it is determined in said second step that the process cartridge is not new.

6. A method according to claim 5, further comprising a fifth step of the writing date information in the memory means, after execution of the image forming operation in said fourth step.

* * * * *

UNITED STATES PATENT AND TRADEMARK OFFICE

CERTIFICATE OF CORRECTION

PATENT NO. : 6,947,676 B2
APPLICATION NO. : 10/136388
DATED : September 20, 2005
INVENTOR(S) : Akira Hayakawa It is certified that error appears in the above-identified patent and that said Letters Patent is hereby corrected as shown below:

ON THE TITLE PAGE
At Item (56), Foreign Patent Documents,
"07092752 4/1995" should read --7-92752 4/1995--.
"09073254 3/1997" should read --9-73254 3/1997--.

COLUMN 6
Line 35, "get" should be deleted.

COLUMN 11
Line 32, "Embodiment I" should read --Embodiment 1--.

COLUMN 12
Line 6, "de"should read --dc--.

Signed and Sealed this

Eighth Day of August, 2006

JON W. DUDAS
*Director of the United States Patent and Trademark Office*